US011078912B2

(12) United States Patent
Al-Hasan et al.

(10) Patent No.: US 11,078,912 B2
(45) Date of Patent: Aug. 3, 2021

(54) AUTOMOTIVE AUXILIARY ASSEMBLY VACUUM PUMP HAVING A SINGLE-PIECE FLANGE ELEMENT

(71) Applicant: PIERBURG PUMP TECHNOLOGY GMBH, Neuss (DE)

(72) Inventors: Nabil Salim Al-Hasan, Korschenbroich (DE); Tobias Gruene, Arnsberg (DE); Sebastian Cramer, Pulheim (DE); Steffen Schnurr, Essen (DE)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 205 days.

(21) Appl. No.: 16/315,656

(22) PCT Filed: May 10, 2017

(86) PCT No.: PCT/EP2017/061145
§ 371 (c)(1),
(2) Date: Jan. 7, 2019

(87) PCT Pub. No.: WO2018/007052
PCT Pub. Date: Jan. 11, 2018

(65) Prior Publication Data

US 2019/0338642 A1 Nov. 7, 2019

(30) Foreign Application Priority Data

Jul. 8, 2016 (DE) ..... 2016 112 555.5

(51) Int. Cl.
*F04C 25/02* (2006.01)
*F01C 21/02* (2006.01)
(Continued)

(52) U.S. Cl.
CPC ..... *F04C 25/02* (2013.01); *F01C 21/02* (2013.01); *F01C 21/108* (2013.01);
(Continued)

(58) Field of Classification Search
CPC ..... F01C 21/02; F01C 21/108; F01C 21/10; F01C 21/106; F04C 25/02; F04C 18/344;
(Continued)

(56) References Cited

U.S. PATENT DOCUMENTS 5,149,257 A 9/1992 Iio
6,491,505 B1 12/2002 Hueser et al.
(Continued)

FOREIGN PATENT DOCUMENTS

CN 205136015 U 4/2016
EP 2 532 895 A1 12/2012
EP 2 626 510 A1 8/2013

OTHER PUBLICATIONS

English Translation of EP2626510A1, translated on Sep. 15, 2020. (Year: 2013).*

*Primary Examiner* — Mary Davis
*Assistant Examiner* — Paul W Thiede
(74) *Attorney, Agent, or Firm* — Norman B. Thot

(57) ABSTRACT

An automotive auxiliary assembly vacuum pump includes a housing composite structure with an electric motor section, a pump section, a pump inlet opening, and a pump outlet opening, a motor housing part, a bearing plate which closes the motor housing part proximally, and a pump rotor with a rotor body. The electric motor section includes a motor rotor which is surrounded by the motor housing part and which is closed by the bearing plate. The pump section includes a pump housing which defines a pump chamber and which includes a closure element, at least one pump chamber inlet opening, and at least one pump chamber outlet opening. The pump housing is formed at least by axially proximal and axially distal thrust washers and a radial thrust ring. Only the bearing plate and the axially proximal thrust washer are provided as a single-piece flange element.

7 Claims, 4 Drawing Sheets

(51) Int. Cl.
*F01C 21/00* (2006.01)
*F04C 18/344* (2006.01)
*F01C 21/10* (2006.01)

(52) U.S. Cl.
CPC ..... *F04C 18/344* (2013.01); *F04C 2220/10* (2013.01); *F04C 2220/12* (2013.01); *F04C 2230/41* (2013.01); *F04C 2240/30* (2013.01)

(58) Field of Classification Search
CPC ..... F04C 2230/41; F04C 2240/30; F04C 2230/92; F04C 11/008; F04C 2240/40; F04C 2270/12; F04C 29/0035; F04C 2220/10; F04C 2220/12; F04C 29/045; F04C 29/06; F04C 29/066; F05C 2201/021
USPC .... 418/55.1, 2, 191, 201.1, 201.3; 417/44.1, 417/199.2, 423.4, 423.5
See application file for complete search history.

(56) References Cited

U.S. PATENT DOCUMENTS

| | | | |
|---|---|---|---|
| 2003/0129053 | A1 | 7/2003 | Nonaka et al. |
| 2004/0191099 | A1* | 9/2004 | Moradmand ..... F04B 53/109 417/470 |
| 2009/0132038 | A1 | 5/2009 | Grimme et al. |
| 2014/0161647 | A1 | 6/2014 | Al-Hasan et al. |
| 2016/0017885 | A1 | 1/2016 | Al-Hasan et al. |
| 2016/0153452 | A1 | 6/2016 | Nagano et al. |
| 2016/0333877 | A1 | 11/2016 | Tsuda |

* cited by examiner

AUTOMOTIVE AUXILIARY ASSEMBLY VACUUM PUMP HAVING A SINGLE-PIECE FLANGE ELEMENT

CROSS REFERENCE TO PRIOR APPLICATIONS

This application is a U.S. National Phase application under 35 U.S.C. § 371 of International Application No. PCT/EP2017/061145, filed on May 10, 2017 and which claims benefit to German Patent Application No. 10 2016 112 555.5, filed on Jul. 8, 2016. The International Application was published in German on Jan. 11, 2018 as WO 2018/007052 A1 under PCT Article 21(2).

FIELD

The present invention relates to an automotive auxiliary assembly vacuum pump which is configured as a dry-running vane cell pump which is driven by an electric motor, having a housing composite structure which has an electric motor section, a pump section, and a pump inlet opening and a pump outlet opening, wherein the electric motor section has a motor rotor which is surrounded in a radial and axially distal manner by a motor housing part which is closed proximally by a bearing shield which supports a bearing, wherein the pump section has a pump housing which defines a pump chamber and has a closure element, wherein the pump housing is formed at least by an axially proximal thrust washer, an axially distal thrust washer, and a radial thrust ring, wherein the pump housing has at least one pump chamber inlet opening and at least one pump chamber outlet opening, wherein the motor rotor is oriented coaxially with a pump rotor which is arranged in the pump chamber and the rotor body of which has at least three rotor blades which are mounted displaceably on the rotor body.

BACKGROUND

In automobiles, such auxiliary assembly vacuum pumps serve to supply other assemblies, such as a brake booster, for example, with an absolute negative pressure of 100 millibars and less and/or with a positive pressure. In order to be independent of the rotational speed of the automotive drive motor, such as an internal combustion engine, when providing the negative or the positive pressure, vacuum pumps driven by an electric motor are employed which are usually configured as vane cell pumps having at least three vanes.

DE 199 36 644 A1 describes a typical setup of an electric automotive auxiliary assembly vacuum pump. The motor rotor is thereby placed in a housing part which is proximally closed by a bearing shield comprising a radial bearing for mounting the rotor shaft. A separate thrust washer of the pump housing is arranged adjacent to the bearing shield on the side facing away from the motor, which thrust washer, together with a second thrust washer and a circular thrust ring, forms a pump housing defining and/or enclosing a pump chamber. The pump rotor is arranged in the pump chamber. The rotor body of the pump rotor comprises a plurality of rotor vanes which are displaceably supported therein. The vacuum pump is laborious to assemble since it is composed of many parts, and because the housing part, the bearing shield, and the thrust ring must be exactly axially aligned with each other.

Dry-running vane cell pumps are employed to reduce lubricant supply and to avoid contaminating the air exiting the vacuum pump. High demands are made on the rotor vane/thrust ring material pairing of the vacuum pump because the lubrication of the dry-running vacuum pump is omitted, wherein an excessive wear of the thrust ring, which slides on the head of the rotor vane must in particular be avoided.

In order to solve this problem, EP 2 626 510 A1 describes configuring the bearing shield, the axially proximal thrust washer, and the thrust ring as an integral body, wherein this integral body is made from aluminum and can be hardened, for example, anodized. A vacuum pump of such a design is, however, expensive to manufacture. The intended object is furthermore a permanent effort to further minimize the installation space and to simplify assembly.

SUMMARY

An aspect of the present invention is to reduce the manufacturing costs of an automotive auxiliary assembly vacuum pump, to simplify the assembly of such a pump, and to further minimize installation space.

In an embodiment, the present invention provides an automotive auxiliary assembly vacuum pump which is configured as a dry-running vane cell pump and which is driven by an electric motor. The automotive auxiliary assembly vacuum pump includes a housing composite structure comprising an electric motor section, a pump section, a pump inlet opening, and a pump outlet opening, a motor housing part, a bearing shield configured to support a bearing and to close the motor housing part proximally, and a pump rotor comprising a rotor body which comprises at least three rotor blades which are displaceably mounted on the rotor body. The electric motor section comprises a motor rotor which is surrounded in a radial distal manner and in an axially distal manner by the motor housing part and which is closed proximally by the bearing shield. The pump section comprises a pump housing which is configured to define a pump chamber and which comprises a closure element, at least one pump chamber inlet opening, and at least one pump chamber outlet opening. The pump housing is formed at least by an axially proximal thrust washer, an axially distal thrust washer, and a radial thrust ring. The pump rotor is arranged in the pump chamber. The motor rotor is oriented coaxially with the pump rotor. Only the bearing shield and the axially proximal thrust washer are configured as a single-piece flange element. The pump inlet opening and/or the pump outlet opening are provided in the bearing shield, and/or the pump chamber inlet opening and/or the pump chamber outlet opening corresponding thereto are provided in the axially proximal thrust washer.

BRIEF DESCRIPTION OF THE DRAWINGS

The present invention is described in greater detail below on the basis of embodiments and of the drawings in which.

DETAILED DESCRIPTION

Figure 1:
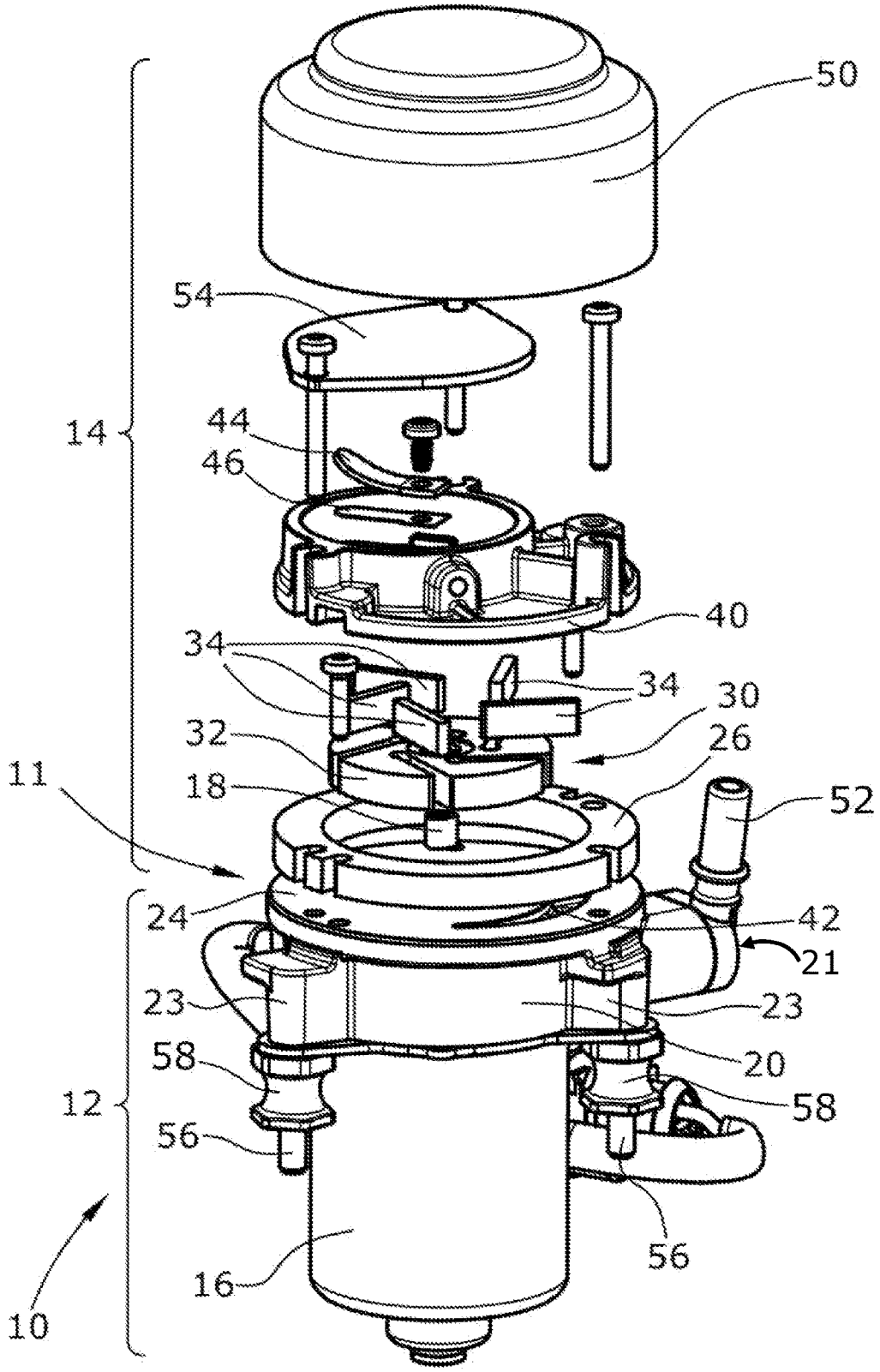
FIG. 1 shows a perspective view of an automotive auxiliary assembly vacuum pump in a partially disassembled state.
Figure 2:
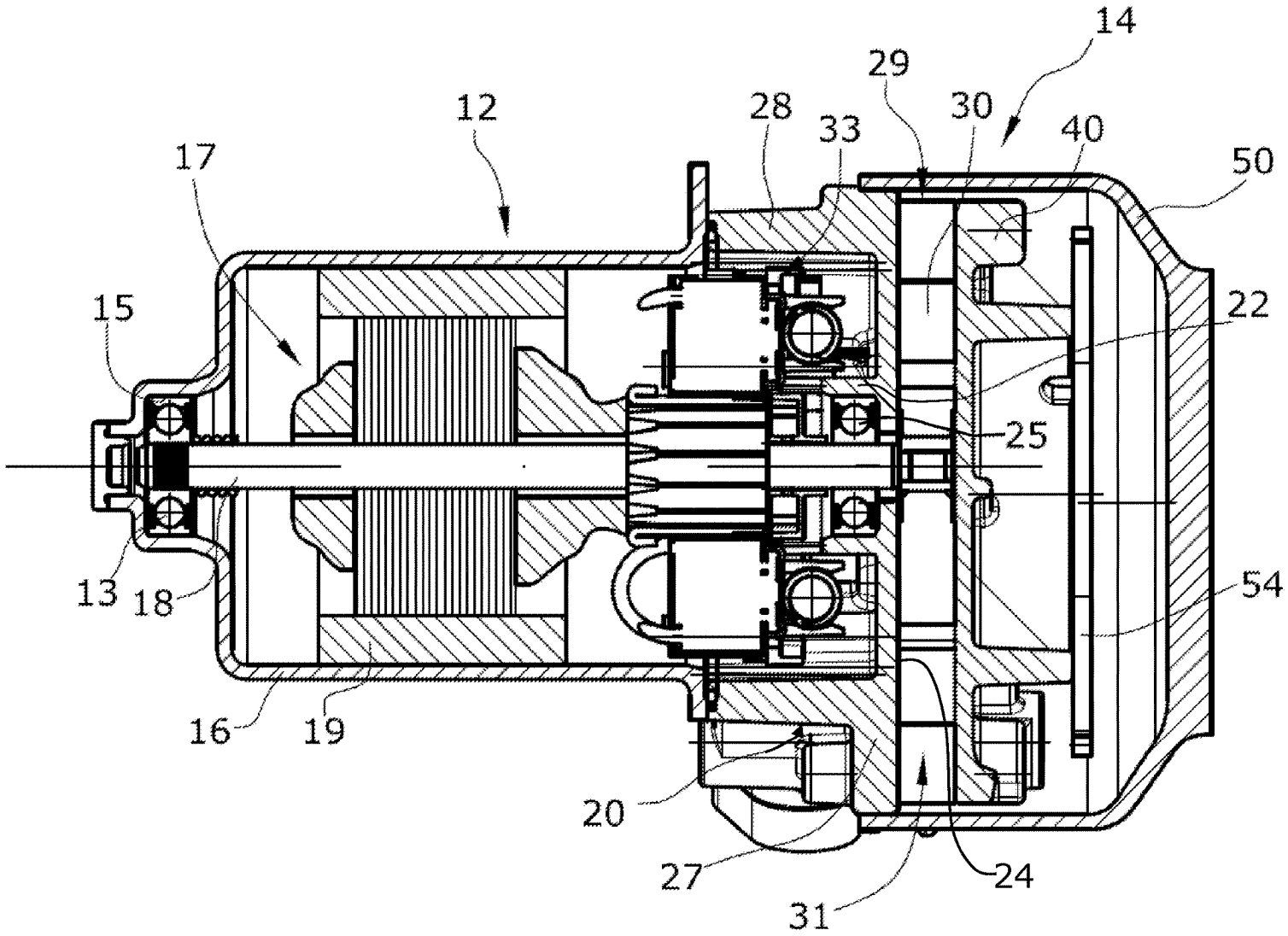
FIG. 2 shows a longitudinal section of the automotive auxiliary assembly vacuum pump of FIG. 1.
Figure 3:
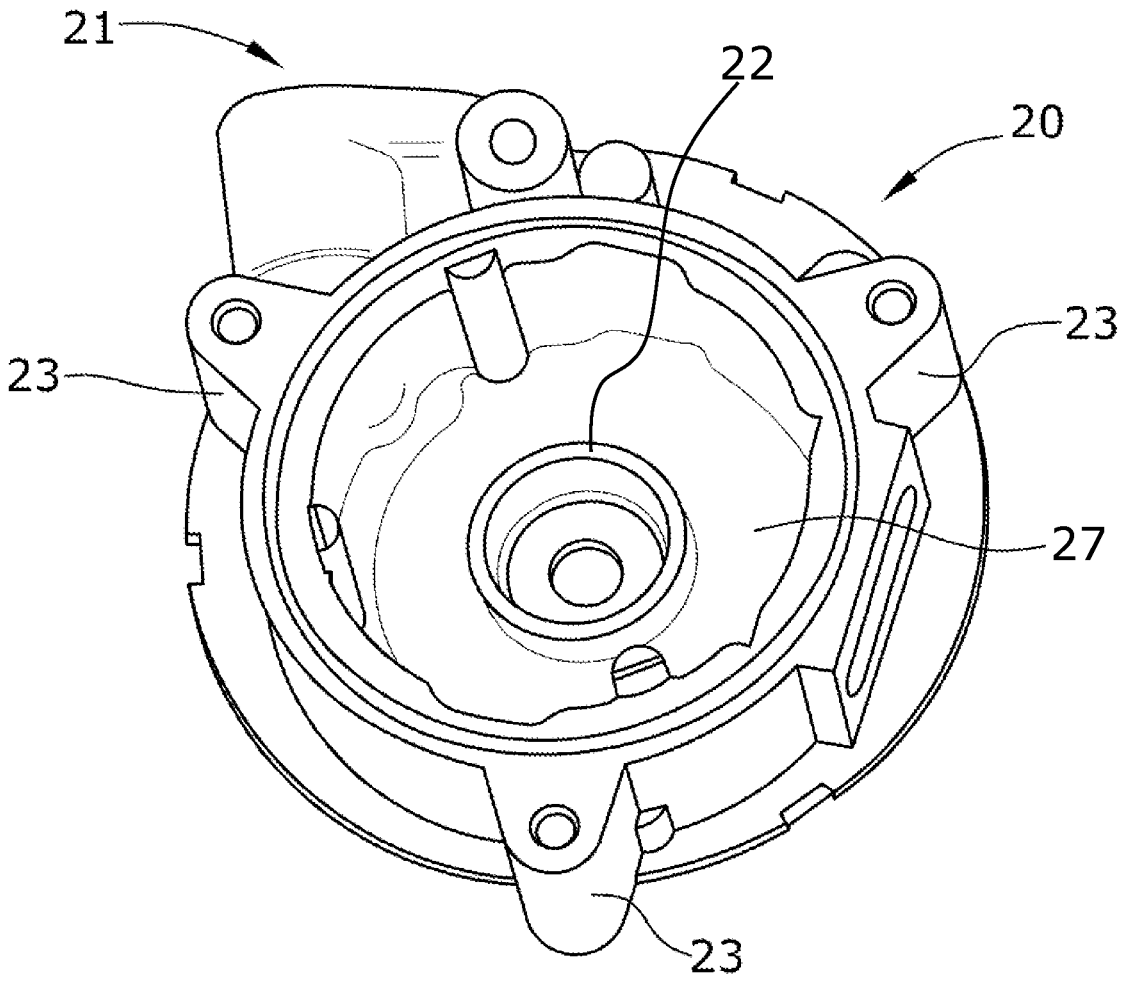
FIG. 3 shows a perspective view of the flange element from the bottom.
Figure 4:
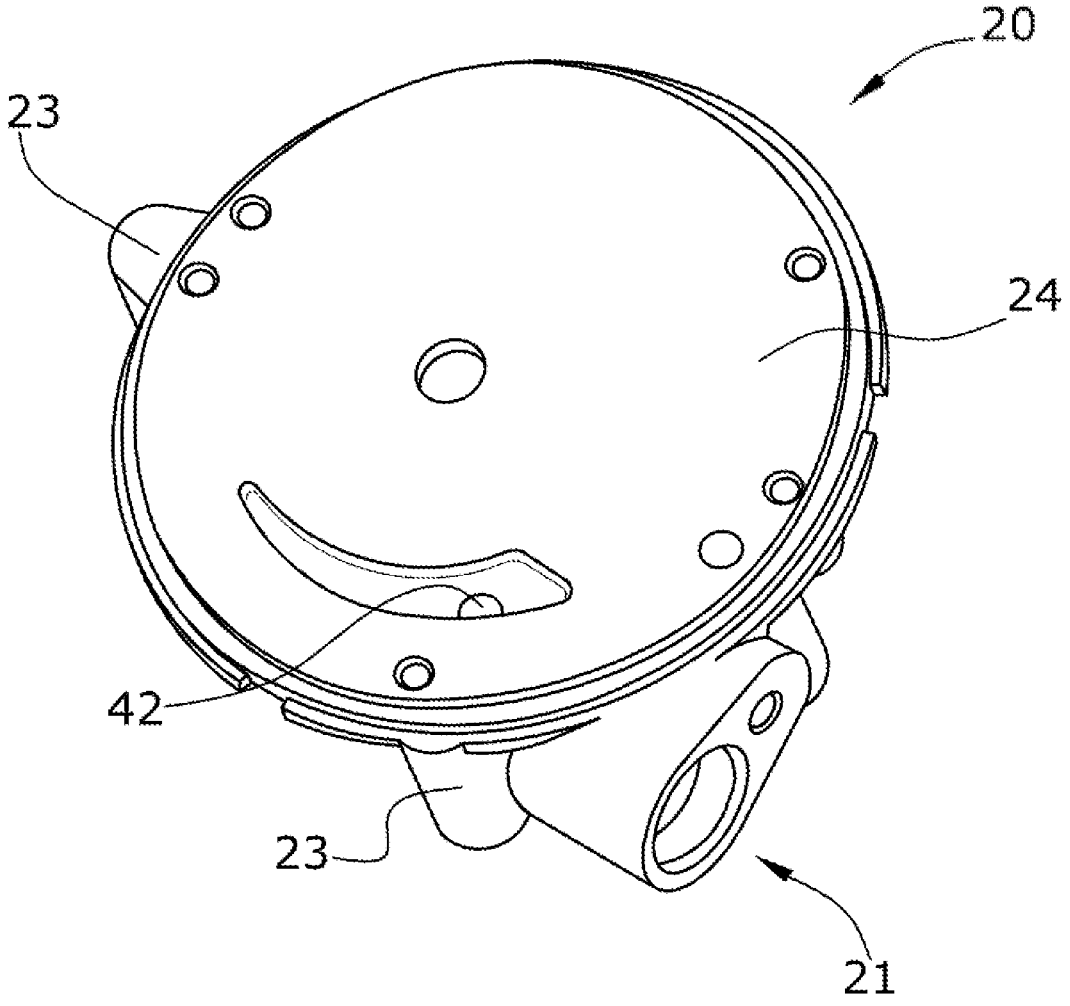
FIG. 4 shows a perspective view of the flange element from the top.

The present invention exclusively configures the bearing shield and the axially proximal thrust washer as a single-piece flange element, wherein, in the bearing shield the pump inlet opening and/or in the axially proximal thrust washer, the corresponding pump chamber inlet opening and/or the pump outlet opening and, in the axially proximal thrust washer, the corresponding pump chamber inlet opening and/or pump chamber outlet opening, are provided.

The present invention provides that only the bearing shield and the axially proximal thrust washer are configured as a single-piece flange element. Such a flange element is much easier and thus more inexpensive to manufacture. The flange element acting as a bearing shield closes the motor housing part at its axially proximal end and forms or retains a radial bearing for the rotor shaft. The radial bearing may be a sliding bearing or a rolling bearing. The bearing shield and the adjacent thrust washer are constituted by a single washer body, wherein one side thereof forms the bearing shield and the other side thereof forms the adjacent thrust washer. The vacuum pump can be designed considerably more flexibly and the air passage can be considerably simplified by arranging the pump inlet opening and/or the pump outlet opening in the flange element.

In an embodiment of the present invention, the single-piece flange element can, for example, be made from aluminum. Aluminum components are very light while displaying a high stability and, due to the hardening, are adequately protected against wear by the softer rotor vane head. At least the thrust washer of the single-piece flange element can, for example, be hardened, for example, anodized, over the entire surface. Such a hard anodized coating is sufficiently hard so that high wear-resistance of the thrust washer is provided.

In an embodiment of the present invention, a commutator assembly of the electric motor section can, for example, be mounted in the flange element. The coaxiality of the motor section and the pump section is thereby positively created. Assembling is thus considerably simplified and the overall length is reduced.

In an embodiment of the present invention, the flange element can, for example, comprise at least one radial assembling unit having a plug-in opening for screwing-in a retaining screw. The flange element thus possesses an additional function which only entails little additional costs due to its integration in a single component.

In an embodiment of the present invention, the flange element can, for example, comprise a branch element to the pump inlet or the pump outlet opening for simple connection to a pressure-controlled component.

In an embodiment of the present invention, the pump outlet opening can, for example, be provided in the closure element.

An exemplary embodiment of the present invention is explained in detail below under reference to the drawings.

The drawings show an automotive auxiliary assembly vacuum pump 10 which is configured as a dry-running vane cell pump driven by an electric motor. In an automobile which is driven, for example, by an internal combustion engine, the vacuum pump 10 serves as an auxiliary assembly for providing an absolute negative pressure of 100 millibars or less. The vacuum pump 10 is operated at a constant rated rotational speed of approximately 3000 rpm, but can generally also be operated at a variable rotational speed. The vacuum pump 10 comprises a housing composite structure 11 and is functionally divided into an electric motor section 12 and a pump section 14 in the longitudinal direction.

In the electric motor section 12, a rotatably mounted rotor shaft 18 is provided to which a motor rotor 17 is fastened for rotation therewith, which motor rotor 17 can be configured so that it is, for example, permanent-magnetically excited. A stationary motor stator 19 having a plurality of stator coils is also provided in the electric motor section 12. A motor housing is essentially formed by a motor housing part 16 which comprises a bearing recess 15 for a bearing configured as a radial bearing 13 at its axially distal end, which bearing can, for example, be configured as a rolling bearing. The electric motor section 12 is proximally closed by a bearing shield 22 which supports a radial bearing 25 configured as a radial-axial bearing for mounting the rotor shaft 18. The radial bearing 25 is configured as a rolling bearing, but can generally also be configured as a sliding bearing. The bearing shield 22 is formed by a disk body 27 lying in a transverse plane, which disk body 27 forms part of a single-piece flange element 20. The motor housing part 16 is fastened to an annular flange portion 28 of the flange element 20. A commutator assembly 33 as well as electric components (which are not shown in the drawings) of the electric motor section 12 are fastened to the inner surface of this annular flange portion 28. In combination with the integrated bearing shield 22, a coaxiality of the pump section 14 with the electric motor section 12 is thereby provided in a particularly simple manner.

The pump section 14 is formed by the rotor shaft 18 to which a pump rotor 30 mounted in an overhung position is fastened for rotation therewith, the pump housing 29 defining a pump chamber 31, and an axially distal thrust washer 40 which acts as a closure disk. The pump rotor 30 comprises a rotor body 32 having five rotor vanes 34 displaceably mounted at the rotor body 32, whose rotor vane heads are made from graphite and which separate the plurality of pump cells from each other. The rotor body 32 is fastened to the rotor shaft 18 for rotation therewith and is axially displaceable to a certain extent so that the pump rotor 30 can always assume an axial position as frictionless as possible between the two thrust washers 24, 40. The pump housing 29 is formed by the axially proximal thrust washer 24, the axially distal thrust washer 40 axially opposite the axially proximal thrust washer 24 relative to the pump rotor 30, and a thrust ring 26, and is covered by a closure lid 50 as the closure element which is clamped to the flange element 20.

A pump chamber inlet opening 42 is provided in the axially proximal thrust washer 24. A pump chamber outlet opening 46 equipped with a corresponding check valve 44 is provided in the axially distal thrust washer 40, which pump chamber outlet opening 46 is covered by a lid element 54 so that a sound-proof chamber is created. In the present exemplary embodiment, one pump chamber outlet opening 46 is provided, it is, however, also possible to provide a plurality of pump chamber outlet openings. The flange element 20 directly adjoining the axially proximal thrust washer 24 comprises a pump inlet branch 52 leading to a pump inlet opening 21 which is fluidically connected to the pump chamber inlet opening 42. The compressed air is discharged via a pump outlet branch (not shown in the drawings) which is fluidically connected to the pump outlet opening.

The single-piece flange element 20 comprises the disk body 27 having the bearing shield 22 and the axially proximal thrust washer 24. The flange element 20 is a single-piece aluminum die-cast component which is provided with a coating over the entire surface, the coating being produced by anodizing the flange element 20.

Three radial assembling elements 23 each having an opening for screwing-in a retaining screw 56 are provided at the disk body 27. A respective dampening element 58 is provided at the retaining screw 56. The motor housing part 16 is clamped to the flange element 20 via the dampening element 58. With the aid of the retaining screws 56 and the radial assembling elements 23, which can be provided as assembling noses, the vacuum pump 10 can be mounted in or to the respective automobile in a simple manner.

The pump chamber inlet and/or outlet can, for example, also be integrated in the flange element 20.

The present invention is not limited to embodiments described herein; reference should be had to the appended claims.

What is claimed is:

1. An automotive auxiliary assembly vacuum pump which is configured as a dry-running vane cell pump and which is driven by an electric motor, the automotive auxiliary assembly vacuum pump comprising:

a housing composite structure comprising an electric motor section, and a pump section;

a motor housing part;

a single-piece flange element comprising, a bearing shield which comprises a disk body, the bearing shield being configured to support a bearing and to close the motor housing part proximally, and an axially proximal thrust washer; and a pump rotor comprising a rotor body which comprises at least three rotor blades which are displaceably mounted on the rotor body;

wherein, the electric motor section comprises a motor rotor which is surrounded in a radial distal manner and in an axially distal manner by the motor housing part and which is closed proximally by the bearing shield of the single-piece flange element, the pump section comprises a pump housing which is configured to define a pump chamber and which comprises a closure element, at least one pump chamber inlet opening, and at least one pump chamber outlet opening, the pump housing being formed at least by the axially proximal thrust washer of the single-piece flange element, an axially distal thrust washer, and a radial thrust ring, the pump rotor is arranged in the pump chamber, the motor rotor is oriented coaxially with the pump rotor, and a pump inlet opening is provided in the disk body of the bearing shield of the single-piece flange element and the pump chamber inlet opening corresponding thereto is provided in the axially proximal thrust washer.

2. The automotive auxiliary assembly vacuum pump as recited in claim 1, wherein the single-piece flange element is made of aluminum.

3. The automotive auxiliary assembly vacuum pump as recited in claim 2, wherein at least the axially proximal thrust washer of the single-piece flange element is hardened over an entire surface.

4. The automotive auxiliary assembly vacuum pump as recited in claim 1, wherein at least the axially proximal thrust washer of the single-piece flange element is hardened via being anodized over the entire surface.

5. The automotive auxiliary assembly vacuum pump as recited in claim 1, wherein, the electric motor section further comprises a commutator assembly, and the commutator assembly of the electric motor section is at least partially mounted in the single-piece flange element.

6. The automotive auxiliary assembly vacuum pump as recited in claim 1, further comprising:

a retaining screw, wherein, the single-piece flange element further comprises at least one radial assembling element which comprises a plug-in opening for screwing-in the retaining screw.

7. The automotive auxiliary assembly vacuum pump as recited in claim 1, wherein the single-piece flange element further comprises a branch element to the pump inlet opening.

* * * * *